US007648444B2

(12) United States Patent
Johnson

(10) Patent No.: US 7,648,444 B2
(45) Date of Patent: Jan. 19, 2010

(54) LEG EXERCISE DEVICE

(76) Inventor: Ivan J. Johnson, 3928 Lancaster Dr., Pueblo, CO (US) 81005

( * ) Notice: Subject to any disclaimer, the term of this patent is extended or adjusted under 35 U.S.C. 154(b) by 790 days.

(21) Appl. No.: 10/754,513

(22) Filed: Jan. 12, 2004

(65) Prior Publication Data

US 2005/0164844 A1 Jul. 28, 2005

(51) Int. Cl.
*A63B 22/04* (2006.01)

(52) U.S. Cl. ..... 482/52

(58) Field of Classification Search ..... 482/51–54, 482/79, 80, 148, 908, 71, 93, 97, 70; 601/27, 601/29, 33–35
See application file for complete search history.

(56) References Cited

U.S. PATENT DOCUMENTS 3,628,791 A * 12/1971 Garcia ..... 482/51
4,270,749 A 6/1981 Hebern
4,694,684 A * 9/1987 Campbell, III ..... 73/65.07
4,902,002 A * 2/1990 Huang ..... 482/62
4,955,604 A * 9/1990 Pogue ..... 482/99
5,518,476 A 5/1996 McLeon
5,851,166 A 12/1998 Bernardson
6,258,012 B1 * 7/2001 Yoshimura ..... 482/52
6,705,975 B2 * 3/2004 Kuo ..... 482/79
7,097,593 B2 * 8/2006 Chang ..... 482/54

* cited by examiner

*Primary Examiner*—Loan H Thanh
*Assistant Examiner*—Tam Nguyen
(74) *Attorney, Agent, or Firm*—Richard C. Litman

(57) ABSTRACT

The leg exercise device of the present invention is provided a base assembly for supporting an adjustable handle assembly and a footplate support assembly. The handle assembly has a pair of tubular support members secured at a lower end adjacent the center of the base assembly at an angle between 45 degrees and 90 degrees. The handle assembly also includes a U-shaped handle bar having a pair of arms that are telescopically received within the tubular support members, and locking for adjustably securing the handle bar to the tubular support members. A footplate support assembly is secured to the tubular support members for rotatably supporting two footplates for independent pivotal movement on an axis above the center of the base assembly.

8 Claims, 4 Drawing Sheets

LEG EXERCISE DEVICE

BACKGROUND OF THE INVENTION

1. Field of the Invention

The present invention relates to exercising devices and more particularly to an exercising device for stretching the Achilles tendon, calf and extensor muscles of the leg.

2. Description of the Related Art

Many devices are known in the prior art for exercising the leg muscles by repeated bending or flexing of the ankle joints. In U.S. Pat. No. 4,270,749 issued Jun. 2, 1981 to Hebern a device is taught that exercises the leg muscles to improve circulation without requiring excessive exertion.

The Hebern device has a parallelepiped frame defining a stall and a planar treadle mounted on the stall for rocking movement about a horizontal axis extending transversely of the stall in the lower portion of the stall. The treadle includes a metallic plate welded to a metallic tube. The ends of the tube fit within bushings on mounting brackets for pivotal or rocking movement about the axis of the tube. A user stands on the treadle and rocks the treadle about the axis by bending of the ankle joints. The Hebern device is directed at people who are basically healthy and to those who may be crippled and requiring proper circulation in the legs with very little exertion. However, the device of Hebern does not allow the exercising of each leg individually as in the case where only one leg has suffered an injury.

U.S. Pat. No. 5,518,476 issued May 21, 1996 to McLeon teaches a triplane foot and biplane ankle exercise apparatus and method for exercising the subtalar complex with controlled triplaner motion. The device includes a standing platform and a detachable adjustable handrail assembly in association with a rotatable footplate wherein the footplate is controllable and adjustable in three planes with fixed setting in all planes including the oblique. The handrail assembly includes a U-shaped tubular member that telescopes over two intermediate tubular members. Spring biased push buttons are provide on the intermediate members for mating alignment with a series of handrail holes for adjusting the handrail to a persons height. The McLeon device does not address the stretching of the Achilles tendon, calf and extensor muscles of the leg.

In U.S. Pat. No. 5,851,166 issued Dec. 22, 1998 to Bernardson, a lower extremity rehabilitation and toning exercise apparatus and method are taught. The apparatus incorporates one or two centrally pivoted pedals mounted upon a base. The pedals are mounted in a position facilitating the placement of the feet of a user upon the pedals while seated in a chair. Rocking the pedals with the foot positioned upon them provides a soothing tension relieving motion that will maintain the tone of the muscles of the legs and improve blood circulation in the feet and legs. The apparatus of Bernardson is designed for use in a seated position so as not to injure previously injured muscles or ligaments.

Athletes and officials of athletic competitions generally adopt warm-up and stretching routines prior to the start of the contest. This usually includes calisthenics and individual stretching routines such as sitting on the ground and touching your toes and/or pulling on the toes to stretch the back and Achilles tendon. Heretofore, none of the prior art foot and leg exercising devices provided for warm-up exercises stretching the Achilles tendon, calf and extensor muscles of the leg.

None of the above inventions and patents, taken either singly or in combination, is seen to describe the instant invention as claimed. Thus a leg exercise device solving the aforementioned problems is desired.

SUMMARY OF THE INVENTION

The leg exercise device according to the present invention comprises a base assembly for supporting an adjustable handle assembly and a footplate support assembly. The base assembly is provided in the form an elongated left rail, an elongated right rail, a front base bar and a rear base bar connected end to end forming a rectangular structure for safely supporting the leg exercise device on any flat surface.

The handle assembly has a pair of tubular support members secured at a lower end adjacent the center of the rails of the base assembly at an angle between 45 degrees and 90 degrees toward the forward ends of the rails. The handle assembly also includes a U-shaped handle bar having a pair of arms that are telescopically received within the tubular support members. Means are provided at the top of the tubular support members and on the distal end portions of the arms of the U-shaped handle for adjustably securing the handle bar to the tubular support members. An elongated flat plate is secured by respective ends to the top portion of the tubular support members forming a knee rest and brace for stabilizing the tubular support members in parallel alignment.

A footplate support assembly is secured to the tubular support members for rotatably supporting the weight of an individual upon the two footplates for independent pivotal movement of the footplates about an axis above the center of the base assembly. The handle allow a person using the leg exercise device to easily position themselves in a comfortable stance upon the footplates with the weight of the person balanced above the axis of the footplates.

In this position, the weight of the person may be controllably shifted toward the toes to obtain an extensor muscle stretch or shifted toward the heels to obtain a calf muscle and Achilles tendon stretch. Rocking back and forth in this manner also warms up the ankle and improves circulation to the legs and foot for rehabilitation of injured or painful Achilles tendon, extensor muscle or calf muscles. The knee guard allows a person to obtain maximum stability when accessing a full extensor muscle stretch.

Accordingly, it is a principal object of the invention to provide a leg exercise device for improved and maximized stretch of the Achilles tendon, extensor and calf muscles prior to engagement in athletic activities.

It is another object of the invention to provide a leg exercise device suitable for rehabilitation of injured or painful Achilles tendons, extensor and calf muscles.

It is a further object of the invention to provide a leg exercise device which limits the stretch without forcing, so that muscles can be stretch using an individual's own weight one leg at a time or both legs simultaneously.

Still another object of the invention is to provide a leg exercise device having a knee guard or knee rest that allows an individual to obtain maximum stability so as to encourage full stretch of the extensor muscle.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
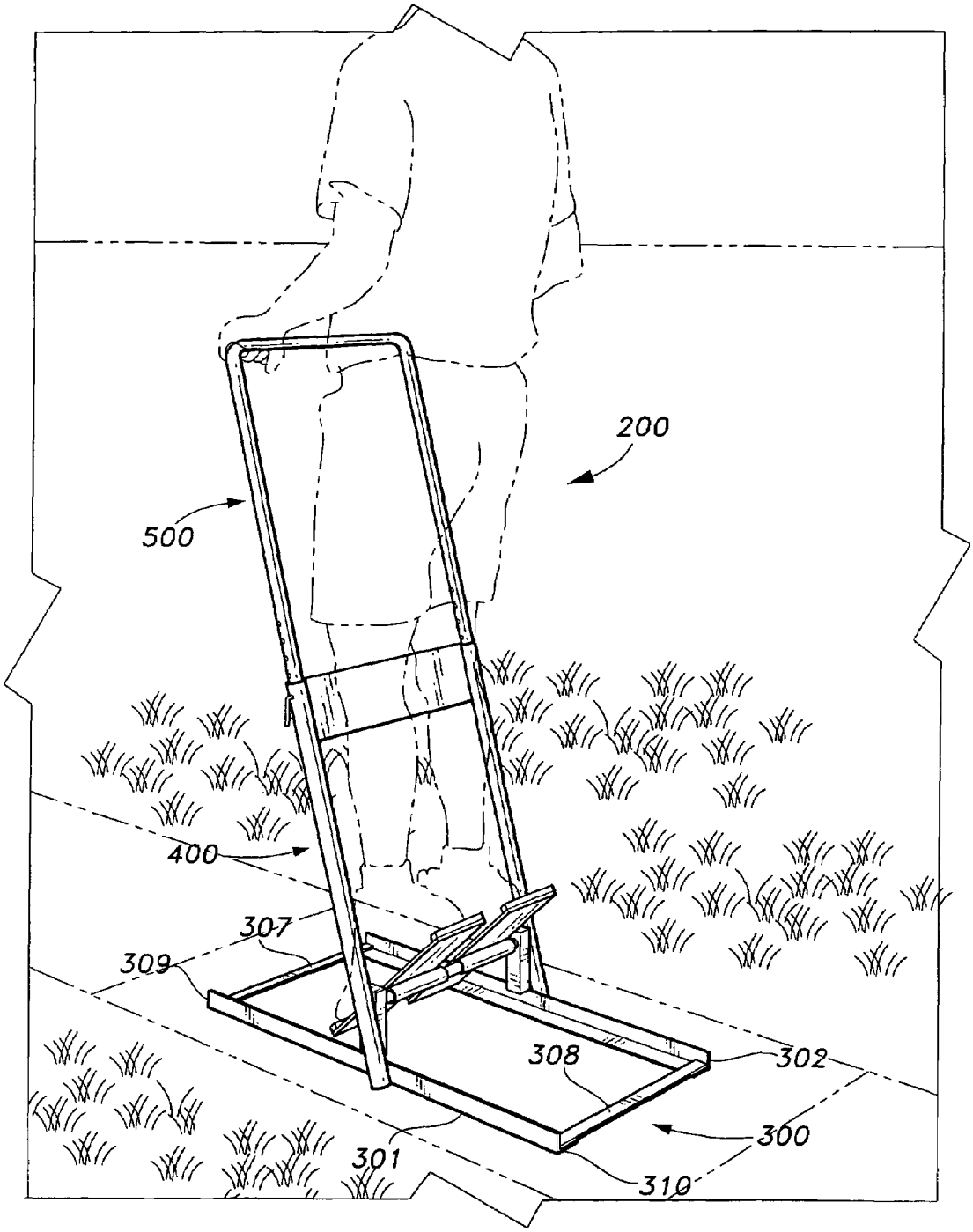
FIG. 1 is an environmental, perspective view of a leg exercise device according to the present invention.
Figure 2:
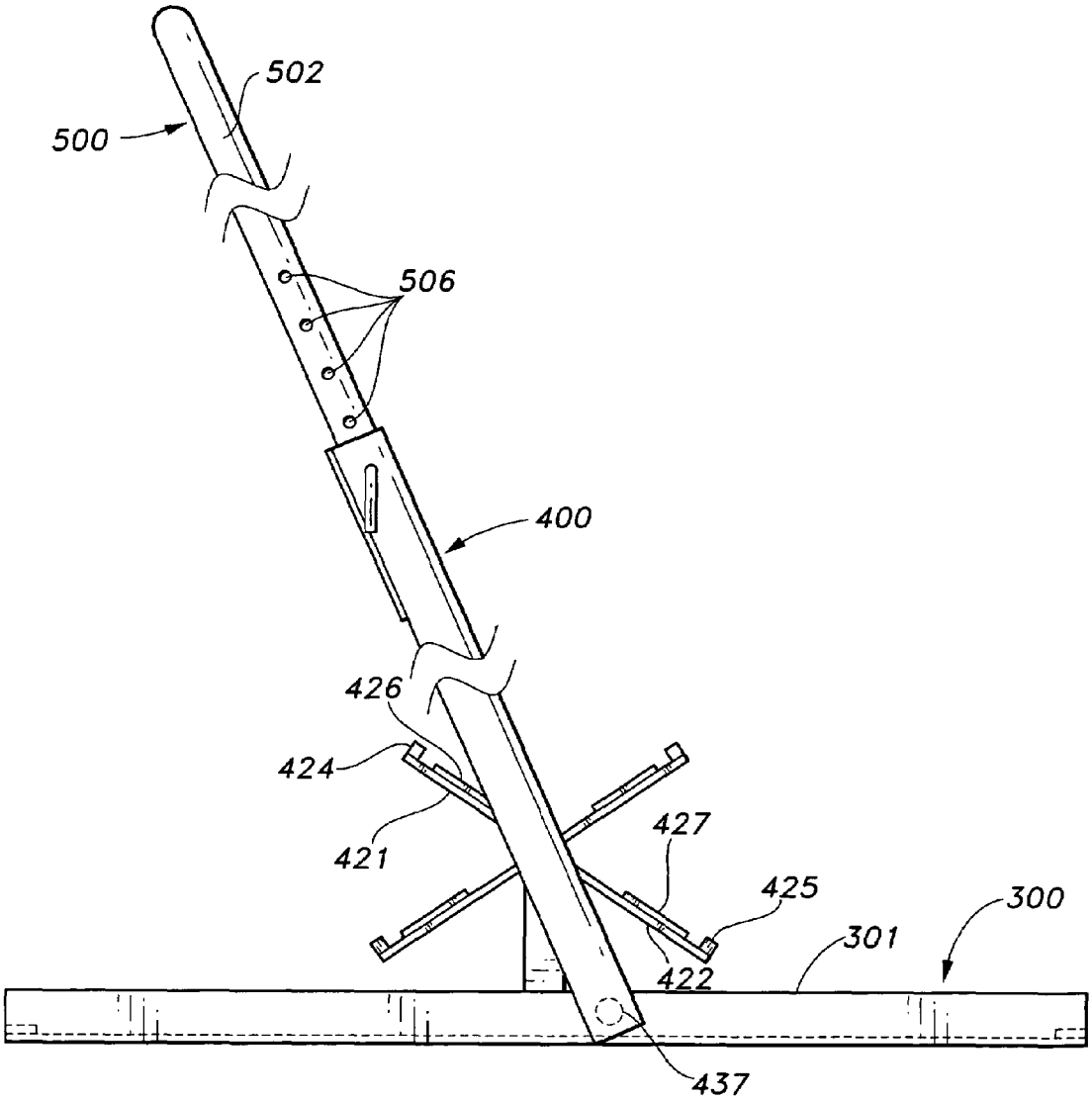
FIG. 2 is a side view of the leg exercise device according to the present invention.
Figure 4:
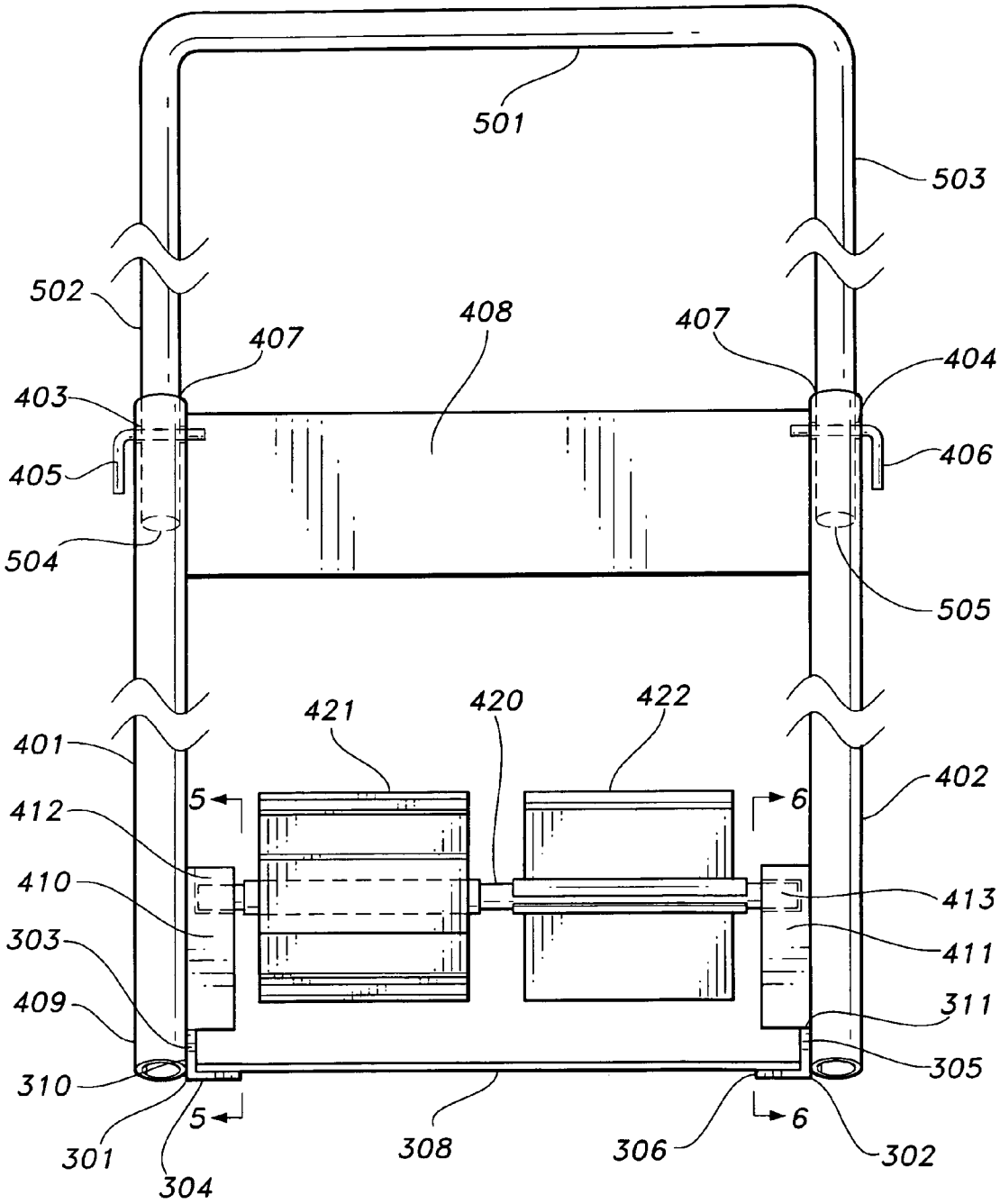
FIG. 4 is a back view of the leg exercise device according to the present invention.

Looking first at FIG. 1, the present invention is a leg exercise device 200 that comprises a base assembly 300 for supporting an adjustable handle assembly 500 and a footplate support assembly 400. The base assembly 300 is provided in the form an elongated left rail 301, an elongated right rail 302, a front base bar 307 and a rear base bar 308 all formed of steel and connected end to end by welding or other suitable means. As best seen in FIGS. 1 and 4, the rails 301,302 are L-shaped in cross-sections with rail 301 having sidewall 303 and bottom wall 304 and rail 302 having a sidewall 305 and a bottom wall 306. The ends of base bar 307 are secured to the front ends 309 of rails 301 and 302 and the ends of base bar 308 are secured to rear end 310 of rails 301 and 302 to form a rectangular structure that safely supports the leg exercise device 200 on any flat surface.

The handle assembly 500 has a pair of tubular support members 401 and 402 secured at lower ends 409 adjacent the center of the rails 301 and 302, respectively of the base assembly 300. Support members 401 and 402 are attached at an angle between 45 degrees and 90 degrees toward the front ends 309 of the rails 301 and 302, respectively. The handle assembly 500 also includes a U-shaped handle bar having a handle 501 forming the base of the U and pair of arms 502 and 503 that are telescopically received within the tubular support members 401 and 402, respectively. Locking means are provided at the top of the tubular support members 401 and 402 and on the distal end portions of the arms 502 and 503 of the U-shaped handle for adjustably securing the handle bar to the tubular support members 401 and 402.

The locking means is provided in the form of aligned apertures 403 and 404 at the upper open end 407 of tubular support members 401 and 402, and a plurality of aligned apertures 506 at the end portions 504 and 505 of arms 502 and 503, respectively. An elongated flat plate 408 has ends secured to the top portions of the tubular support members forming a knee rest and brace for stabilizing the tubular support members 401 and 402 in parallel alignment. Pegs 405 and 406 cooperate with the aligned apertures of the tubular members 401 and 402 and the aligned apertures 506 of the arms 502 and 503, respectively to lock the handle assembly 500 at various heights suitable for different people.

Figure 3:
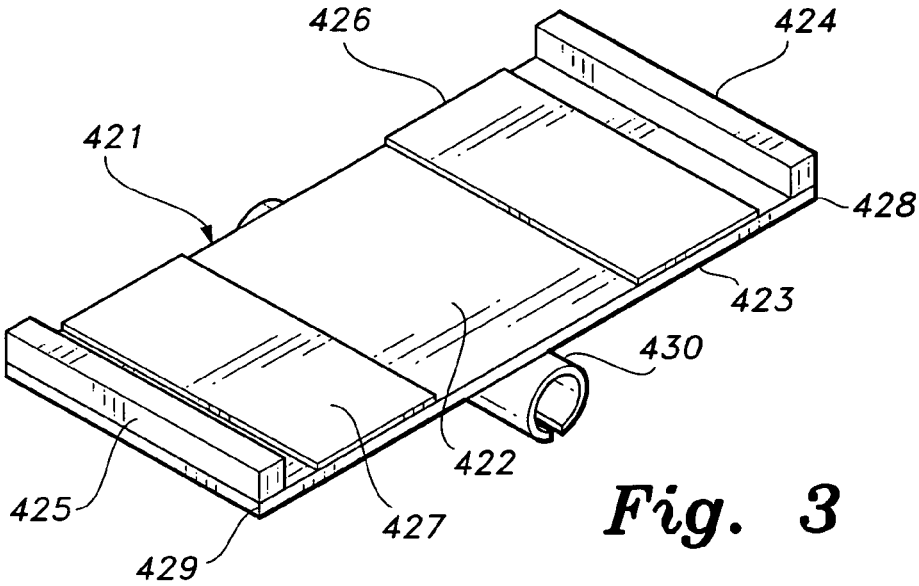
FIG. 3 is a perspective view of the footplate of the leg exercise device according to the present invention.

Referring now to FIG. 3, the footplate support assembly comprises flat elongated metal footplates 421 sized to fit a range of shoe sizes. The forward end 428 of the footplates have a toe stop in the form of a metal bar 424 secured thereto and the rear end of the plates 421 have a heel stop 425 secured thereto. Stops 424 and 425 are secured to the top face 422 of footplates 421 and 422 by welding or any suitable means. Non skid strips 426 and 427 are adhesively secured to top face 422 of foot plates 421 adjacent the front 428 and rear 429 ends of the footplates 421. A tubular metal sleeve 430 having a longitudinal slot is attached by welding or other suitable means to the center of the bottom face 423 of footplates 421 transverse the longitudinal axis of the footplates 421. The sleeves 430 of footplates 421 are rotatably received around a steel axle rod 420.

Figure 6:
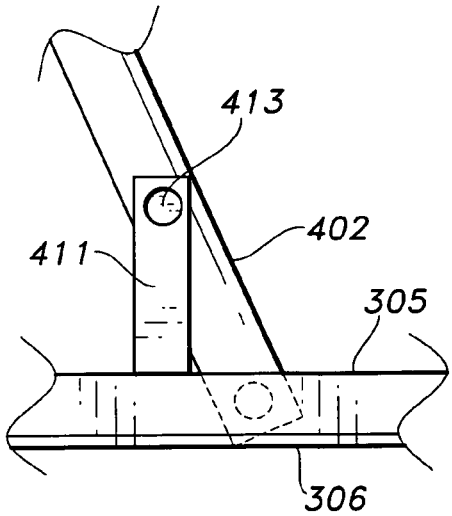
FIG. 6 is a view of the footplate assembly according to the present invention taken at 6-6 of FIG. 4.
Figure 5:
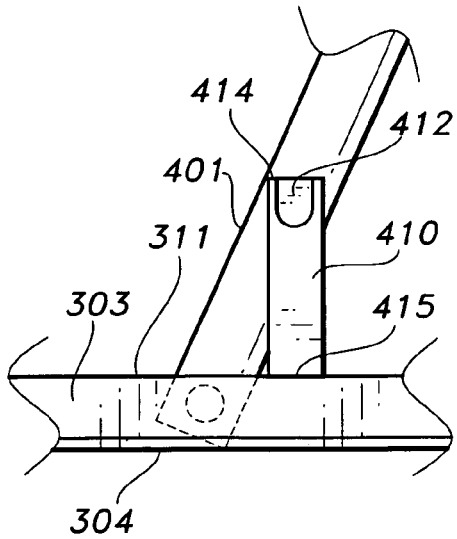
FIG. 5 is a view of the footplate support assembly according to the present invention taken at 5-5 of FIG. 4.

Turning now to FIGS. 4-6, a first axle support brace is provided in the form of a metal block 410 attached on one side by welding or other suitable means to the lower end of tubular support member 401. A slot 412 opens on the top end 414 and side opposite the attached side of block 410 for rotatably receiving one end of the axle rod 420. A second axle support brace is provided in the form of a metal block 411 is attached on one side by welding or other suitable means to the lower end of tubular support member 402. A bore 413 is provided adjacent the top end 414 of block 411 on the side opposite the attached side of block 411 for rotatably receiving the second end of the axle rod 420. Blocks 410 and 411 are attached to the tubular support members 401 and 402, respectively so as to be perpendicular to the longitudinal axis of rails 301 and 302. The bottom ends of blocks 410 and 411 engage the top edge 311 of rails 301 and 302 to firmly support the axle rod 420 and footplates over the center of the base assembly 300 for rotatably supporting the weight of an individual upon two footplates.

The handle 501 allow a person using the leg exercise device 200 to easily position themselves in a comfortable stance upon the footplates 421 with the weight of the person balanced above the axis of the footplates 421.

In a variation of the preferred embodiment of the invention, the lower ends of tubular support members 401 and 402 are pivotally mounted to sidewalls 303 and 305 of rails 301 and 302, respectively by any suitable pivot connection. This pivotal arrangement allows the handle assembly 500 to be pivoted downwardly to a compact storage position.

It is to be understood that the present invention is not limited to the embodiments described above, but encompasses any and all embodiments within the scope of the following claims.

I claim:

1. A leg exercise device, consisting essentially of:

a pair of footplates, each of said footplates including a tubular metal sleeve having a longitudinal slot attached to the center of a bottom face of each footplate transverse to the longitudinal axis of said footplates for rotatably supporting said pair of footplates upon an axle rod;

a footplate support assembly for rotatably supporting said pair of footplates on the axle rod on a base assembly;

an adjustable handle assembly for assisting a user to position themselves in a comfortable stance upon said footplates with the user balanced above said axle rod, wherein said handle assembly includes a first tubular support member and a second tubular support member, said support members being secured at a lower end on opposite sides of said base assembly adjacent the center of said base assembly, said support members extending forward to form an acute angle relative to the said base assembly, said handle assembly further including an elongated flat plate secured at one end to an exterior portion of said upper end of said first tubular support member and secured at a second end to an exterior portion of said upper end of said second tubular support member, said elongated flat plate forming a knee rest and brace for stabilizing said tubular support members in parallel alignment; and said footplate support assembly being secured to said tubular support members for rotatably supporting an individual upon said footplates above said base assembly for independent pivotal movement about said axle rod, wherein said footplate support assembly includes a first axle rod support brace being configured for rotatably receiving one end of said axle rod, a second axle rod support brace being configured for rotatably receiving a second end of said axle rod, wherein said base assembly is provided in the form an elongated left rail, an elongated right rail, a front base bar and a rear base bar connected end to end forming a rectangular structure for safely supporting the leg exercise device on any flat surface.

2. The leg exercise device according to claim 1, wherein said handle assembly further includes a U-shaped handle bar having a first arm telescopically received within an upper end of said first tubular support member and a second arm telescopically received within an upper end of said second tubular support member.

3. The leg exercise device according to claim 2, wherein said handle assembly further includes means provided at said upper end of said tubular support members and on distal end portions of said arms of said U-shaped handle for adjustably securing said distal end portions of said arms within said tubular support members.

4. The leg exercise device according to claim 1, wherein said left and right rails are L-shaped in cross-section.

5. The leg exercise device according to claim 4, wherein said rails and said bars are formed of steel and are connected by welding.

6. The leg exercise device according to claim 1, wherein said acute angle is between 45 degrees and 90 degrees.

7. The leg exercise device according to claim 1, wherein said footplates include elongated metal footplates adapted to fit a range of shoe sizes, each footplate having a toe stop in the form of a metal bar and a heel stop in the form of a metal bar secured onto a top face of said footplate adjacent a front and rear end, respectively of said footplates, and non-skid strips secured to said top face of said footplates.

8. The leg exercise device according to claim 1, wherein said first axle support brace configuration is in the form of a metal block having a slot open on a top end of said block and along a side of said block for rotatably receiving one end of said axle rod and said second axle support brace configuration is provided in the form of a metal block having a bore adjacent a top end of said block facing said slot for rotatably receiving a second end of said axle rod.

* * * * *